US007514988B2

(12) United States Patent
Uehara

(10) Patent No.: US 7,514,988 B2
(45) Date of Patent: Apr. 7, 2009

(54) BAND GAP CONSTANT-VOLTAGE CIRCUIT

(75) Inventor: Osamu Uehara, Chiba (JP)

(73) Assignee: Seiko Instruments Inc., Chiba (JP)

( * ) Notice: Subject to any disclaimer, the term of this patent is extended or adjusted under 35 U.S.C. 154(b) by 0 days.

(21) Appl. No.: 11/706,479

(22) Filed: Feb. 15, 2007

(65) Prior Publication Data

US 2007/0210856 A1 Sep. 13, 2007

(30) Foreign Application Priority Data

Feb. 18, 2006 (JP) ..... 2006-041690

(51) Int. Cl.
*G05F 1/10* (2006.01)

(52) U.S. Cl. ..... 327/539

(58) Field of Classification Search ..... 327/143, 327/539

See application file for complete search history.

(56) References Cited

U.S. PATENT DOCUMENTS 5,867,013 A * 2/1999 Yu ..... 323/314
6,018,235 A * 1/2000 Mikuni ..... 323/313
6,677,808 B1 * 1/2004 Sean et al. ..... 327/539
6,906,581 B2 * 6/2005 Kang et al. ..... 327/539
7,148,672 B1 * 12/2006 Holmes ..... 323/316
7,259,543 B2 * 8/2007 Chih ..... 323/316
7,321,256 B1 * 1/2008 Vasudevan ..... 327/539

FOREIGN PATENT DOCUMENTS

JP 2004-318604 11/2004

* cited by examiner

*Primary Examiner*—Jeffrey S Zweizig
(74) *Attorney, Agent, or Firm*—Brinks Hofer Gilson & Lione

(57) ABSTRACT

Provided is a band gap constant-voltage circuit capable of achieving a quick startup time to thereby preventing an output voltage from being stabilized at 0 V due to noise or the like even under the normal condition. The band gap constant-voltage circuit according to the present invention includes: an output voltage detecting circuit for monitoring a voltage at an output terminal; and a current source which has a current value controlled through an output of the output voltage detecting circuit, in which the current source supplies a bipolar transistor constituting a level shifter circuit with a current when the voltage at the output terminal is lower than a predetermined voltage.

2 Claims, 2 Drawing Sheets

BAND GAP CONSTANT-VOLTAGE CIRCUIT

This application claims priority under 35 U.S.C. §119 to Japanese Patent Application No. JP2006-041690 filed Feb. 18, 2006, the entire content of which is hereby incorporated by reference.

BACKGROUND OF THE INVENTION

1. Field of the Invention

The present invention relates to a band gap constant-voltage circuit, in particular, a startup circuit capable of securely outputting an output voltage upon power-up to thereby achieve a quick startup time.

2. Description of the Related Art

FIG. 2 is a circuit diagram of a conventional band gap constant-voltage circuit. The voltage circuit is constituted of PMOS transistors P21, P22, P23, P24, and P25, NMOS transistors NL21, NL22, and NL23, an n-channel type depression transistor ND21, bipolar transistors B21 and B22, and resistors R21, R22, R23, and R24, and capacitor C21. In FIG. 2, when a ratio of the number of the bipolar transistor B21 provided as a first bipolar transistor to that of the bipolar transistor B22 provided as a second bipolar transistor is set to 1:N, an output voltage VREF expressed by an equation 1 can be obtained under a normal condition.

$$VREF=VBE+Vtx1nN(1+R21/R22) \quad \text{(equation 1)}$$

In the equation 1, VBE is a voltage applied across the base and the emitter of a bipolar transistor, and Vt is obtained by the equation of Vt=kT/q, where k is a Boltzmann constant, T is an absolute temperature, and q is an electron charge. A state where the output voltage VREF is outputted is referred to as normal condition.

Therefore, the conventional example of FIG. 2 is configured so as to be capable of outputting a predetermined output voltage VREF from an output terminal under a stable normal condition when a power supply voltage is applied across a power supply terminal VDD of high potential and a power supply terminal VSS of low potential.

(Patent Document 1) JP 2004-318604 A

However, the conventional band gap constant-voltage circuit shown in FIG. 2 is slow in startup upon power-on, and therefore has a drawback in that the output voltage is stabilized at 0 V due to noise or the like even under the normal condition.

SUMMARY OF THE INVENTION

The present invention has been made to solve the above-mentioned problem, and has an object to provide a band gap constant-voltage circuit capable of achieving a quick startup time upon power-on to thereby preventing an output voltage from being stabilized at 0 V due to noise or the like even under the normal condition.

According to the band gap constant-voltage circuit of the present invention, in order to solve the above-mentioned problem, a voltage of an output terminal VREF11 is monitored through a gate of a transistor NM11. Further, the drain of a transistor P119 is connected to an emitter of a bipolar transistor B11 so as to cause a current to flow through the bipolar transistor.

According to the band gap constant-voltage circuit of the present invention having the above-mentioned configuration, it is possible to achieve a quick startup time upon power-on and to prevent an output voltage from being stabilized at 0 V due to noise or the like even under the normal condition.

DETAILED DESCRIPTION OF THE PREFERRED EMBODIMENTS

Figure 1:
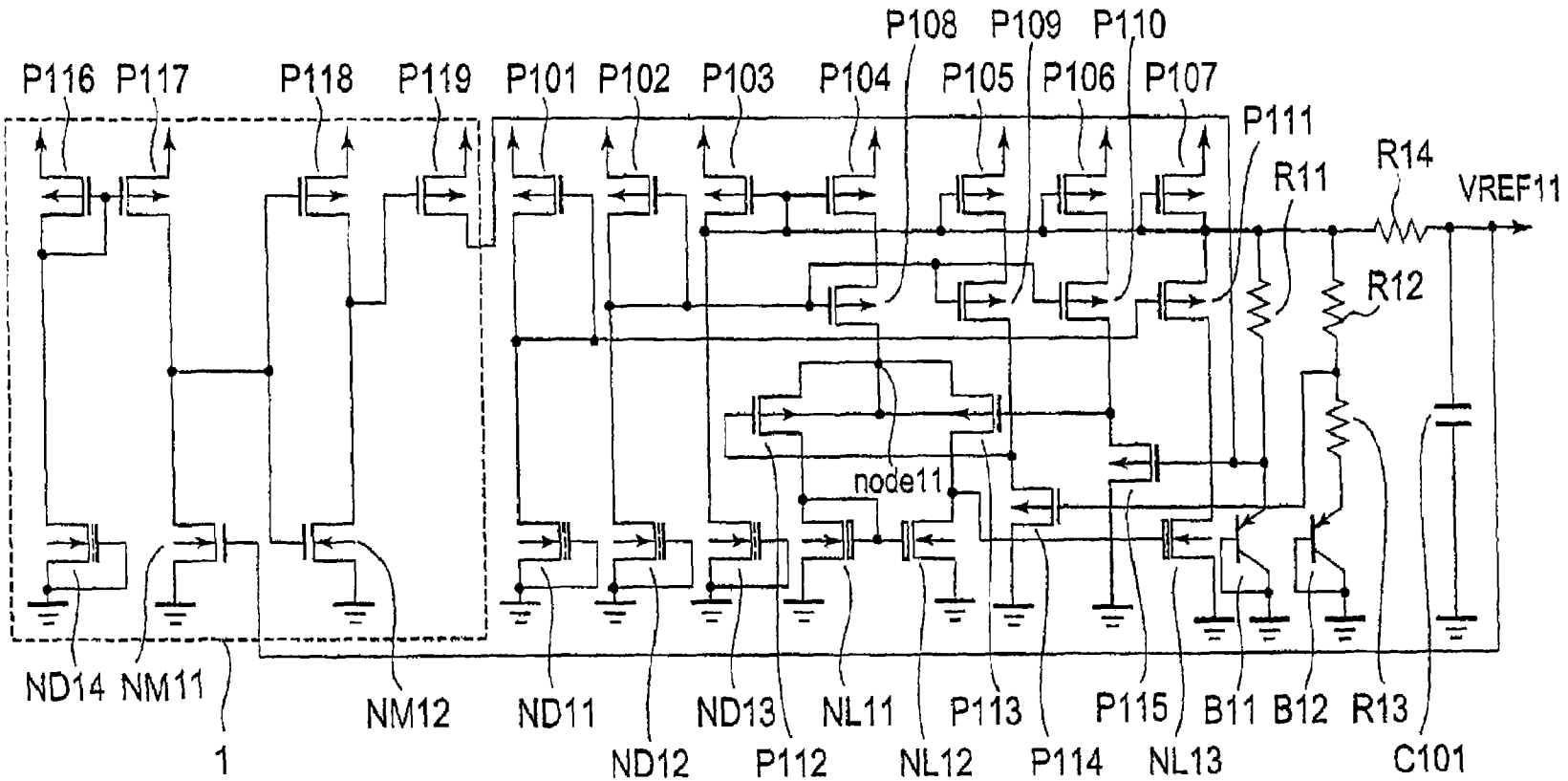
FIG. 1 is a circuit diagram showing a band gap constant-voltage circuit according to the present invention.
Figure 2:
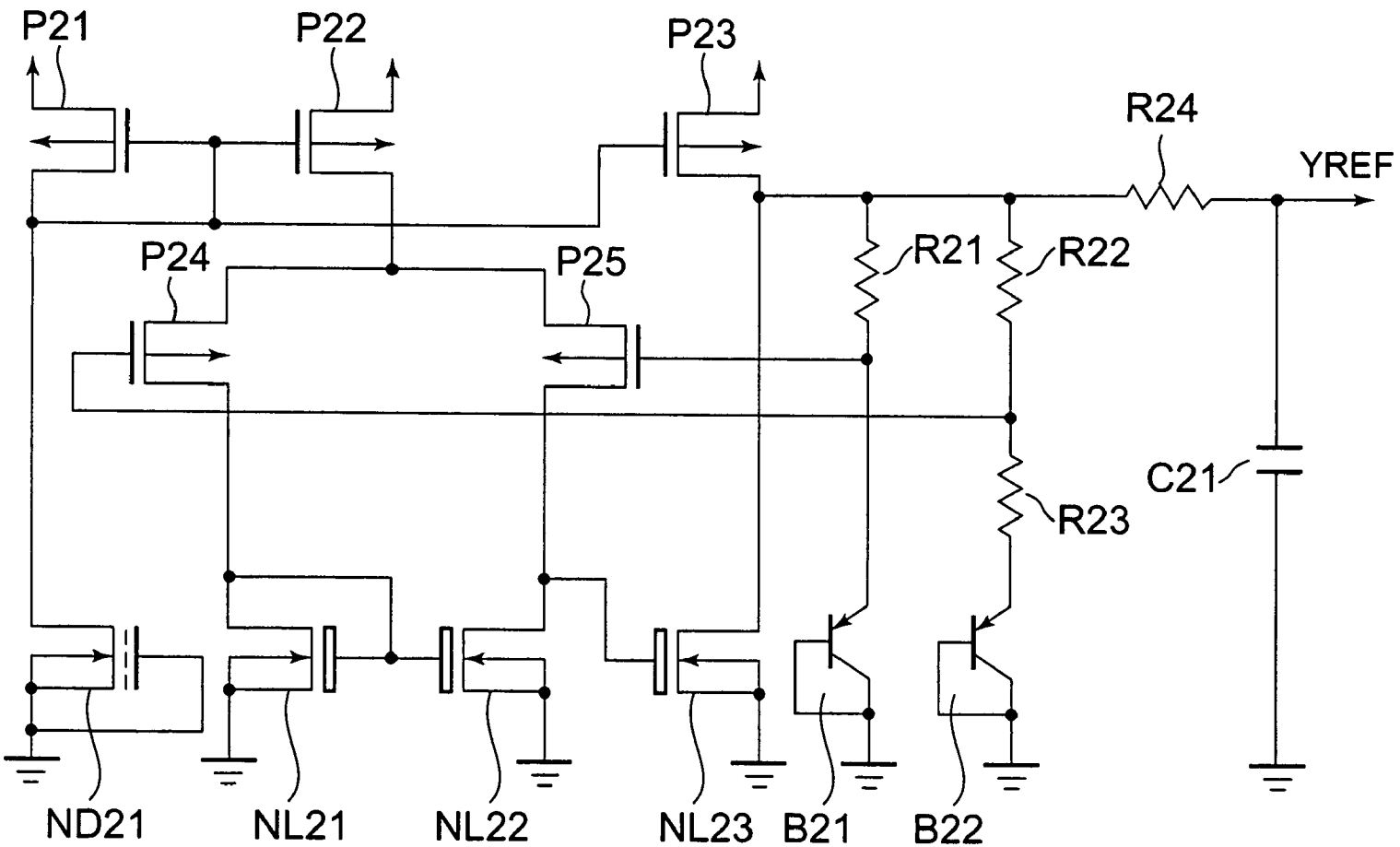
FIG. 2 PRIOR ART
FIG. 2 is a circuit diagram showing a conventional band gap constant-voltage circuit.

FIG. 1 is a circuit diagram showing a band gap constant-voltage circuit according to the present invention.

As shown in FIG. 1, the band gap constant-voltage circuit includes a differential amplifier, a level shifter circuit connected to an input of the differential amplifier, and a constant-voltage circuit.

The differential amplifier of the band gap constant-voltage circuit is constituted of a pair of p-channel type transistors P112 and P113, n-channel type transistors NL11 and NL12, the n-channel type transistors NL11 and NL12 each having a low threshold value (of, for example, 0.45 V). (Hereinafter, n-channel type transistor is abbreviated as n-type transistor, and p-channel type transistor is abbreviated as p-type transistor.)

The source of the n-type transistor NL11 is connected to a ground which serves as a reference potential, while the drain thereof is connected to the drain of the p-type transistor P112. Also, the gate of the n-type transistor NL11 is connected to the gate of the n-type transistor NL12. Further, the drain and the gate of the n-type transistor N11 are connected to each other (diode connection). The source of the n-type transistor NL12 is connected to a ground, while the drain thereof is connected to the drain of the p-type transistor P113, and the gate thereof is connected to the gate of the n-type transistor NL11. The sources and the back-gates of the p-type transistor P112 and the p-type transistor P113 are connected at a node 11 in common, and connected to a power supply voltage VCC through a p-type transistor P108 and a p-type transistor P104. The gate of the p-type transistor P112 is connected to the source of a p-type transistor P114, while the gate of the p-type transistor P113 is connected to the source of a p-type transistor P115.

The n-type transistor NL13 having a low threshold voltage (of, for example, 0.45 V) is connected to the output terminal of the differential amplifier, and is connected to the output terminal VREF11 through a p-type transistor P111 and a resistor R14. The source of the p-type transistor P111 is connected to the drain of a p-type transistor P107. The gate of the p-type transistor P107 is connected to the gate of the p-type transistor P104 and is also connected to the gate of a p-type transistor P103 which is used as a constant-current source. The p-type transistor P107 is supplied with a current at the gate from the constant-current source to turn on and off the gate. In response to this, the p-type transistor P107 supplies the output terminal VREF11 with a current from the power supply voltage VCC through the resistor R14.

The p-type transistor P104 is connected to the p-type transistor P103 which is used as a constant-current source. The drain of the p-type transistor P104 is connected to the differential amplifier through the p-type transistor P108, while the source thereof is connected to the power supply voltage VCC. Further, the gate of the p-type transistor P104 is connected to the gate of each of the p-type transistors P107, P106, and P105. At the same time, the gate of the p-type transistor P104 is also connected to the gate of the p-type transistor P103 which is used as a constant-current source. The p-type transistor P104 is supplied with a current at the gate from the constant-current source to turn on and off the gate. In response to this, the p-type transistor P104 supplies the differential amplifier with a current from the power supply voltage VCC. Also, the p-type transistor P103, the p-type transistor P104, the p-type transistor P105, p-type transistor P106, and the p-type transistor P107, which are used as constant-voltage sources, constitute a current mirror circuit.

The p-type transistor P104 is connected to the differential amplifier through the p-type transistor P108 connected in cascode. In this manner, it is possible to prevent a channel length from being modulated, to thereby supply the differential amplifier with a stable current. Similarly, the p-type transistor P105 is connected in cascode with a p-type transistor P109. The p-type transistor P106 is connected in cascode with a p-type transistor P110. The p-type transistor P107 is connected in cascode with the p-type transistor P111.

The p-type transistor P103 and an n-type depression transistor ND13 are connected to each other through the drains thereof, and used as a constant-voltage source. The n-type depression transistor ND13 used as a direct-current power source has the source and the gate connected to a ground, and has the drain connected to the drain of the p-type transistor P103. The source of the p-type transistor P103 is connected to the power supply voltage VCC, while the drain thereof is connected to the drain of the n-type depression transistor ND13. The p-type transistor P103 has the drain and the gate connected to each other (diode connection), and the gate thereof is connected to the gate of each of the p-type transistor P104, p-type transistor P105, p-type transistor P106, and the p-type transistor P107. Similarly, a p-type transistor P102 and an n-type depression transistor ND12 are also used as a constant-voltage source, and the gate of the p-type transistor P102 is connected to the gate of each of the p-type transistor P108, p-type transistor P109, and p-type transistor P110. A p-type transistor P101 and an n-type depression transistor ND11 are also used as a constant-voltage source, and the gate of the p-type transistor P101 is connected to the gate of the p-type transistor P111.

The p-type transistor P114 used as a level shifter circuit has the drain connected to a ground. The source of the p-type transistor P114 is connected to the power supply voltage VCC through the gate of the p-type transistor P112, the p-type transistor P109, and the p-type transistor P105. Also, the gate of the p-type transistor P114 is connected to the output terminal VREF11 through a resistor R12 and R14. Similarly, the p-type transistor P115 used as a level shifter circuit has the drain connected to a ground, while the source thereof is connected to the power supply voltage VCC through the gate of the p-type transistor P113, the p-type transistor P110, and the p-type transistor P106. Also, the gate of the p-type transistor P115 is connected to the output terminal VREF11 through a resistor R11 and R14.

Connected between the output terminal VREF11 and a ground are the resistor R12, the resistor R13, and a bipolar transistor B12 in this order from the output terminal VREF11 side through the resister 14. In addition, connected between the output terminal VREF11 and a ground are the resistor R11 and a bipolar transistor B11 in this order from the output terminal VREF11 side through the resister 14.

The bipolar transistor B12 has the base and the collector both connected to a ground, while the emitter thereof is connected to a resistor R13. The resistor R13 is connected to the bipolar transistor B12 at one end, while connected to the resistor 12 and to the gate of the p-type transistor P114 at the other end. The resistor R12 is connected to the resistor R13 and to the gate of the p-type transistor P114 at one end, while connected to the output terminal VREF11 at the other end through the resister 14.

The bipolar transistor B11 has the base and the collector both connected to a ground, while has the emitter connected to the resistor R11 and to the gate of the p-type transistor P115. Also, the resistor R11 is connected to the bipolar transistor B12 at one end, while connected to the output terminal VREF11 at the other end through the resister 14.

The band gap constant-voltage circuit of the present invention further includes a startup circuit 1 described as follows.

The startup circuit 1 is constituted of an n-type transistor NM11 and a p-type transistor P119. The n-type transistor NM11 is an output voltage detecting circuit for detecting a voltage of the output terminal VREF11. The p-type transistor P119 is a current source controlled by an output from the output voltage detecting circuit.

The n-type transistor NM11 has the gate connected to the output terminal VREF11, and has the source connected to the drain of a p-type transistor P117. The p-type transistor P117 constitutes a current mirror circuit with a p-type transistor P116, and causes a constant current generated by an n-type depression transistor ND14 to flow through the n-type transistor NM11. The n-type depression transistor ND14 used as a direct current source has the source and the gate connected to a ground.

A p-type transistor P118 and an n-type transistor NM12 constitute an inverter. The inverter is connected to a node of the p-type transistor P117 and the n-type transistor NM11 and uses the node as input. The output of the inverter constituted of the p-type transistor P118 and the n-type transistor NM12 is connected to the gate of the p-type transistor P119 which is used as a current source. The source of the p-type transistor P119 is connected to the power source voltage VCC while the drain thereof is connected the emitter of the bipolar transistor B11.

Next, an operation of the above-mentioned startup circuit 1 of the band gap constant-voltage circuit according to the present invention is explained.

When power is turned on, the n-type transistor NM11 remains turned off because the voltage at the output terminal VREF11 is lower than the threshold voltage value of the n-type transistor NM11. Accordingly, the n-type transistor NM12 is turned on and the p-type transistor P119 is turned on. When the p-type transistor P119 is turned on, a current flow through the bipolar transistor B11, which increases a voltage at the emitter of the bipolar transistor B11, with the result that the voltage at the output terminal VREF11 is increased. The voltage at the output terminal VREF11 is increased to exceed the threshold voltage value of the n-type transistor NM11, to thereby turn on the n-type transistor NM11. Therefore, the p-type transistor P118 is turned on and the p-type transistor P119 is turned off, leading to a suspension of a current supply to the bipolar transistor B11.

Therefore, according to the startup circuit 1 described above, it is possible to achieve a quick startup time upon power-up of the band gap constant-voltage circuit. Further, it is also possible to control the startup time upon power-up by adjusting the size of the p-type transistor P119.

Also, the n-type transistor MN11 monitors the voltage at the output terminal VREF11 not only on power-up but all other times and operates so as to keep the voltage at the output terminal VREF11 constant. Therefore, it is also possible to prevent the voltage at the output terminal VREF11 from being stabilized at 0 V due to an influence of noise or the like.

What is claimed is:

1. A band gap constant-voltage circuit configured to supply a constant-voltage to an output terminal, comprising:

a first level shifter circuit comprising a first transistor configured to shift the voltage at the output terminal to a first level voltage, and a second level shifter circuit comprising a second transistor configured to shift the voltage at the output terminal to a second level voltage;

a differential amplifier configured to maintain the voltage at the output terminal at a constant level, the differential amplifier having a first input terminal to receive the first level voltage from the first level shifter and a second input terminal to receive the second level voltage from the second level shifter such that the differential amplifier thereby adjusts the voltage at the output terminal according to a difference between the first and second level voltages; and a startup circuit comprising an output voltage detecting circuit configured to monitor the voltage at the output terminal and a current source responsive, when the voltage at the output terminal is detected by the output voltage detecting circuit to be lower than a predetermined voltage, to modify a current for gating the first transistor of the first level shifter circuit to thereby create a voltage difference between the first and second input terminals of the differential amplifier in order to rapidly raise the voltage at the output terminal, wherein the output voltage detecting circuit comprises a detection transistor gated by the voltage at the output terminal and a constant current circuit configured to supply a constant current to the detection transistor, the detection transistor comprising an n-type transistor connected to the output terminal at its gate, to the constant current circuit at its source and to a ground at its drain, and the constant current circuit comprising a constant current source and a current mirror circuit configured to supply the detection transistor with a current mirrored from a current flowing through the constant current source, the constant current source comprising an n-type depression transistor connected to the current mirror circuit at its drain and to the ground at its source and gate, the startup circuit further comprises an inverter responsive to the current flowing through the detection transistor to turn on and off the current source, the inverter comprising a p-type transistor and an n-type transistor gates of which are connected to each other to constitute an input of the inverter which is connected to the source of the detection transistor, and drains of which are connected to each other to constitute an output of the inverter which gates the current source, and the current source comprises a p-type transistor which is gated by the output of the inverter and connected at its drain to a gate of the first transistor of the first level shifter circuit.

2. A band gap constant-voltage circuit according to claim 1, wherein a startup time upon power-on is controlled by adjusting a size of the p-type transistor of the current source.

* * * * *